US009863176B2

(12) United States Patent
Kellum, III

(10) Patent No.: US 9,863,176 B2
(45) Date of Patent: Jan. 9, 2018

(54) CARRIER AND BRACKET ASSEMBLY FOR WINDOW BALANCE

(71) Applicant: Amesbury Group, Inc., Amesbury, MA (US)

(72) Inventor: Wilbur James Kellum, III, Garretson, SD (US)

(73) Assignee: Amesbury Group, Inc., Amesbury, MA (US)

( * ) Notice: Subject to any disclaimer, the term of this patent is extended or adjusted under 35 U.S.C. 154(b) by 37 days.

(21) Appl. No.: 14/447,355

(22) Filed: Jul. 30, 2014

(65) Prior Publication Data

US 2016/0032635 A1 Feb. 4, 2016

(51) Int. Cl.
*E05D 13/00* (2006.01)
*E05D 15/16* (2006.01)

(52) U.S. Cl.
CPC ..... *E05D 13/14* (2013.01); *E05D 13/12* (2013.01); *E05D 15/16* (2013.01); *E05Y 2201/21* (2013.01); *E05Y 2201/22* (2013.01); *E05Y 2201/64* (2013.01); *E05Y 2600/528* (2013.01); *E05Y 2900/148* (2013.01); *Y10T 16/6298* (2015.01)

(58) Field of Classification Search
CPC ..... Y10T 16/6298; E05D 13/14; E05D 13/12; E05D 15/16; E05D 13/06; E05Y 2201/21; E05Y 2201/64; E05Y 2201/22; E05Y 2900/148; E05Y 2600/528
USPC ..... 16/193; 49/181, 445, 446, 449
See application file for complete search history.

(56) References Cited

U.S. PATENT DOCUMENTS

| | | | |
|---|---|---|---|
| 2,791,795 | A | 5/1957 | Haas |
| 2,987,758 | A | 6/1961 | Osten, Sr. |
| 3,078,523 | A | 2/1963 | Martin |
| 3,114,178 | A | 12/1963 | Wood |
| 3,135,014 | A | 6/1964 | Martin |
| 3,159,883 | A | 12/1964 | Morton |
| 3,172,169 | A | 3/1965 | Anderson |
| 3,256,641 | A | 6/1966 | Johnson |
| 3,280,511 | A | 10/1966 | Johnson |
| 3,358,403 | A | 12/1967 | Dinsmore |
| 3,498,000 | A | 3/1970 | Nobes |
| 3,499,248 | A | 3/1970 | Baer |
| 3,688,441 | A | 9/1972 | Rackard |
| 4,015,367 | A | 4/1977 | DeBruyn |
| 4,027,431 | A | 6/1977 | Rackard |
| 4,078,336 | A | 3/1978 | Prosser |
| 4,300,316 | A | 11/1981 | Ficurilli |
| 4,517,766 | A | 5/1985 | Haltof |
| 4,551,881 | A | 11/1985 | Hoffman |
| 4,570,382 | A | 2/1986 | Suess |
| 4,571,887 | A | 2/1986 | Haltof |
| 4,685,175 | A | 8/1987 | Yonovich |
| 4,724,577 | A | 2/1988 | Langley |
| 4,763,447 | A | 8/1988 | Haltof et al. |
| 4,949,425 | A | 8/1990 | Dodson et al. |

(Continued)

OTHER PUBLICATIONS

PCT International Search Report and Written Opinion in International Application PCT/US2015/042494, dated Oct. 14, 2015, 11 pgs.

*Primary Examiner* — William Miller

(57) ABSTRACT

A carrier for a window sash has a balance connecting portion configured to be connected to a window balance. A vertical rail system is configured to slidingly engage a bracket of the window sash.

10 Claims, 17 Drawing Sheets

(56) References Cited

U.S. PATENT DOCUMENTS

| | | | | |
|---|---|---|---|---|
| D317,713 | S | 6/1991 | Kaplan | |
| 5,033,235 | A | 7/1991 | Stark | |
| 5,036,622 | A | 8/1991 | Stark | |
| 5,117,586 | A | 6/1992 | Stark | |
| 5,119,592 | A | 6/1992 | Westfall et al. | |
| 5,174,064 | A | 12/1992 | Stark | |
| 5,207,025 | A | 5/1993 | Westfall | |
| 5,231,795 | A | 8/1993 | Westfall | |
| 5,331,765 | A | 7/1994 | Dupuis et al. | |
| 5,414,962 | A | 5/1995 | Forbis et al. | |
| 5,440,888 | A | 8/1995 | Cottevieille | |
| 5,448,858 | A | 9/1995 | Briggs et al. | |
| 5,452,495 | A | 9/1995 | Briggs | |
| 5,632,118 | A | 5/1997 | Stark | |
| 5,649,389 | A | 7/1997 | Coddens | |
| 5,694,664 | A | 12/1997 | Newton et al. | |
| 5,737,877 | A | 4/1998 | Meunier et al. | |
| 5,784,840 | A | 7/1998 | Dodson | |
| 5,934,031 | A | 8/1999 | deNormand | |
| 6,026,617 | A | 2/2000 | Stark | |
| 6,041,475 | A | 3/2000 | Nidelkoff | |
| 6,840,011 | B2 | 1/2005 | Thompson et al. | |
| 6,892,494 | B2 | 5/2005 | Malek | |
| 6,934,998 | B1 | 8/2005 | Shuler | |
| 6,948,279 | B1 | 9/2005 | Newton et al. | |
| 7,021,360 | B2 | 4/2006 | Schroder et al. | |
| 7,028,371 | B2 | 4/2006 | VerSteeg et al. | |
| 7,036,275 | B2 | 5/2006 | Quesada | |
| 7,174,939 | B1 | 2/2007 | Spencer | |
| 7,174,941 | B2 | 2/2007 | Schroder et al. | |
| 7,367,162 | B2 | 5/2008 | Lucci | |
| 7,552,510 | B2 | 6/2009 | Harold et al. | |
| 7,552,562 | B2 | 6/2009 | Curtis et al. | |
| 7,568,260 | B2 | 8/2009 | Wu | |
| 7,624,539 | B2 | 12/2009 | Speyer et al. | |
| 7,631,465 | B2 | 12/2009 | Curtis | |
| 7,980,028 | B1 | 7/2011 | Kunz | |
| 8,074,399 | B2 | 12/2011 | Speyer et al. | |
| 8,074,400 | B2 | 12/2011 | Speyer et al. | |
| 8,091,282 | B2 | 1/2012 | Speyer et al. | |
| 8,109,037 | B2 | 2/2012 | Speyer et al. | |
| 8,146,204 | B2 | 4/2012 | Lucci et al. | |
| 8,296,903 | B1 * | 10/2012 | Steen | E05D 13/12 16/197 |
| 8,302,258 | B2 | 11/2012 | Lucci et al. | |
| 8,448,296 | B2 | 5/2013 | Kellum, III et al. | |
| 8,539,717 | B2 | 9/2013 | Speyer et al. | |
| 9,038,315 | B2 * | 5/2015 | Kellum, III | E05D 13/06 49/116 |
| 9,115,522 | B2 * | 8/2015 | Sofianek | E05D 13/12 |
| 2004/0065016 | A1 | 4/2004 | Malek | |
| 2005/0166461 | A1 * | 8/2005 | Lucci | E05D 13/10 49/446 |

* cited by examiner

CARRIER AND BRACKET ASSEMBLY FOR WINDOW BALANCE

INTRODUCTION

Hybrid window balance systems are utilized to lift and lower very heavy window sashes. In general, a hybrid window balance system includes a carrier, a hybrid spring balance to provide an opposing spring force against a weight of a window sash, and a bracket to secure the carrier to the window sash. Typically, play or slop exists between the carrier and the bracket, which can lead to undesirable operation.

SUMMARY

In one aspect, the technology relates to a carrier for a window sash having: a balance connecting portion configured to be connected to a window balance; and a vertical rail system, wherein the vertical rail system is configured to slidingly engage a bracket of the window sash. In an embodiment, a sliding surface is disposed opposite the vertical rail system, wherein the sliding surface is adapted to slide in a jamb channel of a window jamb. In another embodiment, the balance connecting portion is connected to the body. In yet another embodiment, the vertical rail system is at least one of connected to the body and integral with the body. In still another embodiment, the vertical rail system has a first rail member and a second rail member disposed in opposition to the first rail member.

In another embodiment of the above aspect, the first rail member and the second rail member each includes a channel. In an embodiment, the first rail member and the second rail member each has a substantially U-shaped channel. In another embodiment, an open portion of the first rail member faces toward an open portion of the second rail member. In yet another embodiment, a lock is pivotably connected to the body. In still another embodiment, the first rail member and the second rail member at least partially define a bracket receptor, and wherein the lock is configured to pivotally extend into the bracket receptor and pivotally retract from the bracket receptor.

In another embodiment of the above aspect, a brake is pivotally and slidably connected to the body. In an embodiment, a position of the lock is dependent on a position of the brake.

In another aspect, the technology relates to a balance system for a window sash, the balance system includes: a bracket adapted to be secured to the window sash, the bracket having a vertical carrier mating element and an interface surface; and a carrier adapted to be connected to a window balance, the carrier having a body defining a vertical bracket mating element configured to mate with the vertical carrier mating element and a bearing surface configured to engage with the interface surface when the vertical carrier mating element is engaged with the vertical bracket mating element. In an embodiment, the carrier further includes a brake connected to the body, wherein the brake is positionable in a stored position wherein the brake is disposed substantially within the body and an extended position wherein the brake extends from the body. In another embodiment, a pivotable lock is adapted to prevent disengagement of the bracket from the carrier, wherein the pivotable lock is positionable in a locked position wherein the pivotable lock is engaged with the bracket and an unlocked position where the pivotable lock is disposed substantially within the body. In yet another embodiment, a biasing element for biasing the pivotable lock into the unlocked position is included. In still another embodiment, the pivotable lock biases the brake into the extended position.

In another aspect, the technology relates to a balance system for supporting a window sash in a window jamb, the balance system having: a bracket adapted to be secured to a window sash; and a carrier configured to selectively engage the bracket by vertical sliding movement, wherein the carrier is adapted to be secured to a window balance, the carrier having: a brake pivotally connected to the carrier, wherein when the brake is in a deployed position, the brake is configured to engage the window jamb; and a pivotable lock, wherein when the pivotable lock is in a locked position, the pivotable lock engages with the bracket so as to prevent disengagement of the bracket from the carrier. In an embodiment, a position of the brake is dependent on a position of the pivotable lock. In another embodiment, a spring is configured to bias the pivotable lock into an unlocked position and the brake into the deployed position.

In another aspect, the technology relates to a method of installing a window sash on a carrier of a window balance, wherein the carrier is disposed in a window jamb, the method including: extending a brake from the carrier; engaging the brake with an opening in the window jamb; engaging a window sash bracket with the carrier; and storing the brake substantially within the carrier, wherein storing the brake substantially simultaneously extends a lock into a recess in the window sash bracket. In an embodiment, the method includes prior to storing the brake, disengaging the brake from the opening. In another embodiment, the sash bracket is connected to the window sash.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
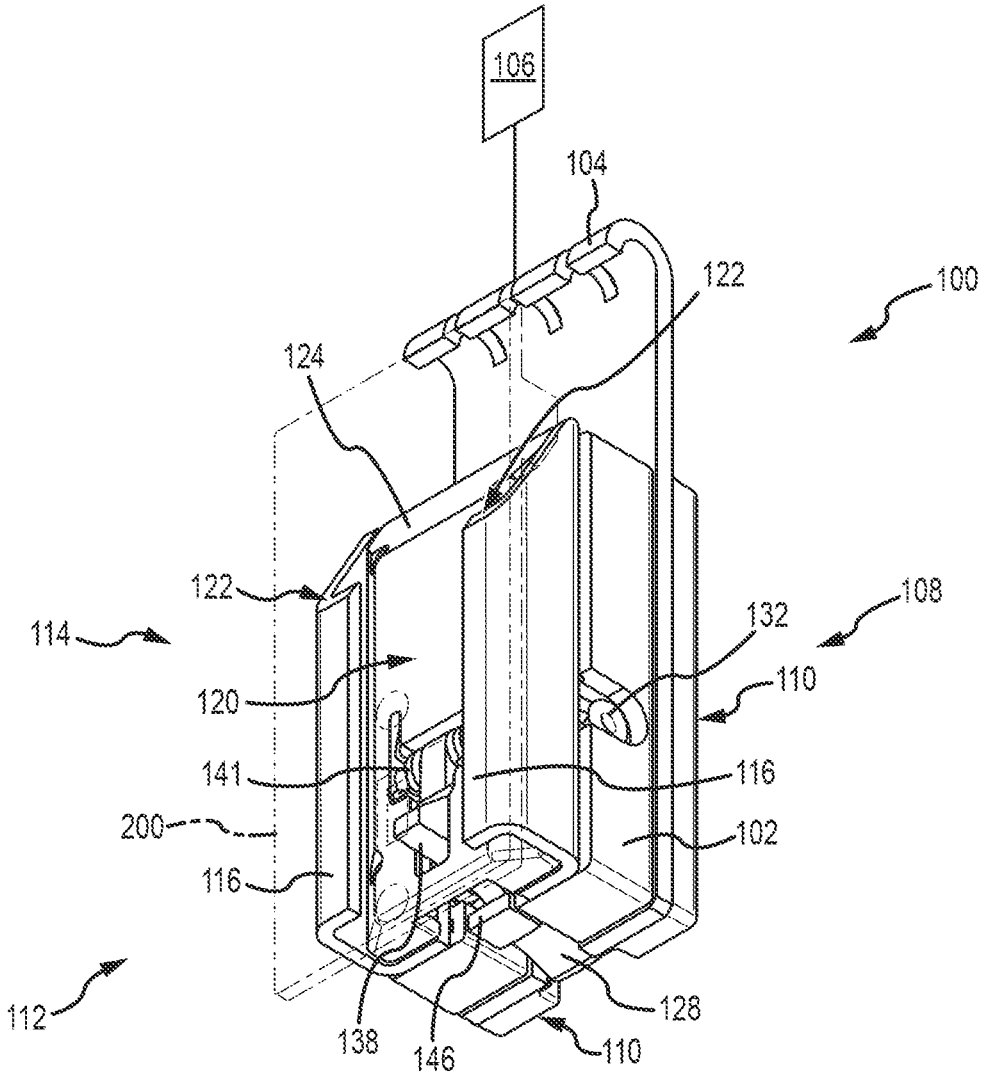
FIG. 1A is an upper perspective view of a carrier for a window balance system.
Figure 1B:
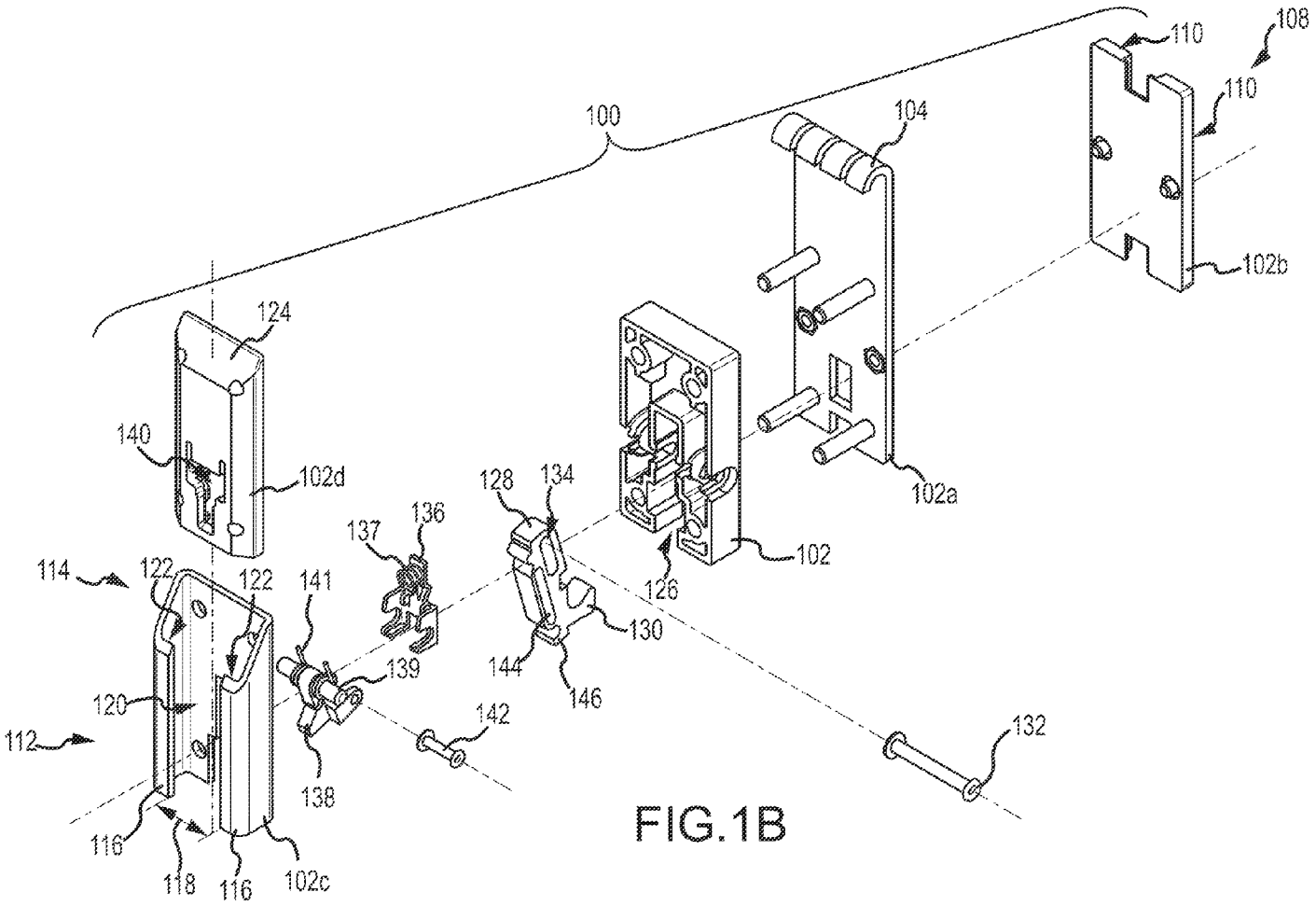
FIG. 1B is an upper exploded perspective view of the carrier of FIG. 1A.

FIG. 1A is an upper perspective view of a carrier 100 for a window balance system and FIG. 1B is an upper exploded perspective view of the carrier 100. FIGS. 1A and 1B are described simultaneously. The carrier 100 includes a body 102 that can be formed from one or more discrete molded components (depicted here as body portions 102 and 102*a*-102*d*). Components 102*a*-102*e* can be discrete from or integral with body 102 and can perform other functions, as described below. A balance hook portion 104 of the body 102*a* is connected to or integral with the body 102. The balance hook portion 104 is configured to be connected to a spring 106 (depicted schematically in FIG. 1A). The spring 106 can include a hybrid extension and spiral spring system or other type of spring as known in the art. A rear side 108 of the body 102*b* can include one or more vertical sliding surfaces 110 secured thereto or formed thereon. The sliding surfaces 110 are configured to slide along a rear wall of a window jamb, when the carrier 100 moves in a window jamb. A front side 112 includes a vertical rail system 114 or bracket mating element that can be connected to or integral with the body 102. The vertical rail system 114 is configured to mate with a bracket 200 as described herein. The bracket 200 is depicted in dashed lines in FIG. 1A for clarity.

The vertical rail system 114 includes, in the depicted embodiment, two U-shaped rail members or channels 116. The channels 116 are integrated into a single body 102*c* and are disposed such that open portions of the channels 116 face towards each other. The channels 116 are spaced apart from each other by a gap 118 and at least partially define a bracket receptor 120 for receipt of the bracket 200. A top portion of each channel 116 defines an angled engagement face 122 that acts as a bearing surface configured to engage the bracket 200, as described below. The body 102*d* of the carrier 100 also includes a guide 124 that aids in installing the bracket 200 in the bracket receptor 120. Portions of the carrier 100 define several openings that receive a number of components that improve performance of the carrier 100. For example, the body 102 at least partially defines a brake opening 126 that receives a brake 128 that includes an anchor hook 130. The brake 128 is slidably and pivotably received within the body 102 via a brake pin 132 and elongate brake pin slot 134 that receives the brake pin 132.

A retention clip 136 is configured to retain the brake 128 when the brake 128 is in a stored position substantially received in the body 102 of the carrier 100. A retention biasing element 137 in the form of a spring biases the retention clip 136 so as to releasably secure the brake 128 in a stored position. An interlocking pawl or lock 138 is pivotably engaged about an axle 139 with the retention clip 136 and disposed substantially within a lock opening 140. A torsion spring 141 is configured to bias the lock 138 towards the brake 128. The lock 138 and brake 128 are engaged via an engagement pin 142 and an elongate engagement pin slot 144. Thus, certain movements of the brake 128 are dependent on certain movements of the lock 138. For example, the brake 128 can slide up and down within the body 102. However, the spring 141 biases the lock 138 towards the brake 128; thus, a pivoting movement of the lock 138 causes a corresponding pivoting movement of the brake 128. The brake 128 also defines a projection 146 that can be accessed by a tool or finger as described in further detail below.

Figure 2:
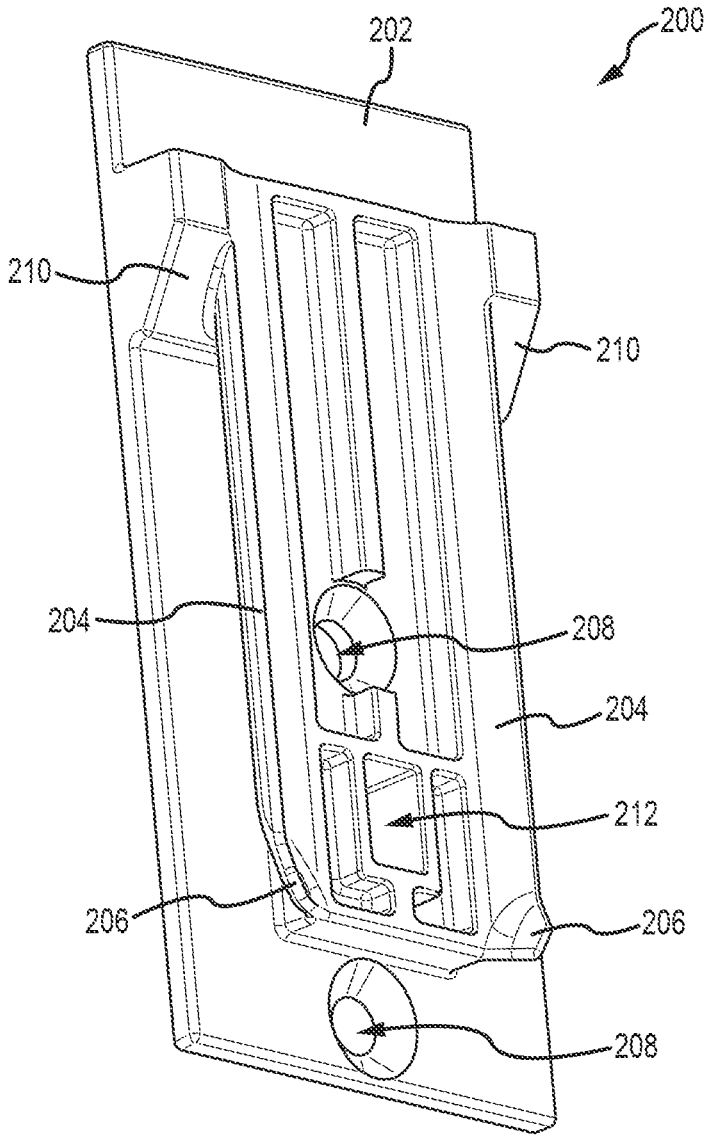
FIG. 2 depicts a perspective view of a bracket for a window balance system.

FIG. 2 depicts a perspective view of a bracket 200 for a window balance system. The bracket 200 includes a plate 202. Two vertical carrier mating elements in the form of elongate projections 204 extend from the plate 202 and are configured to slidingly engage with the channels 116 when the bracket 200 is mated with the bracket receptor 120. Bottom portions 206 of each projection 204 can be angled so as to more easily align with top portions of the channels 116 during engagement thereof. The plate 202 can define one or more fastener openings 208 for securing the bracket 200 to a stile of a window sash. The fastener openings 208 can be sized to receive screws, bolts, or other types of mechanical fasteners. Alternatively or additionally, adhesives may also be utilized. Shoulders 210 are disposed proximate the upper portion of each projection 204 and form interface surfaces to engage or otherwise rest on the angled engagement faces 122 on the carrier 100, when the bracket 200 is completely engaged therewith. The shoulders 210 are angled relative to the projections 204 and the mating angled engagement faces 122 of the carrier 100 form a tight connection with the shoulders 210, thus reducing or eliminating play between the bracket 200 and the carrier 100. In alternative embodiments, the carrier can include a stop proximate a lower portion of the carrier (e.g., at a bottom of the bracket receptor), such that the bracket can rest against the stop. The bracket 200 also defines a recess 212 that is configured to receive the pivotable lock 138 when that element is in an extended position. Multiple recesses can be utilized, depending on the number of locks utilized in the carrier.

Figure 3A:
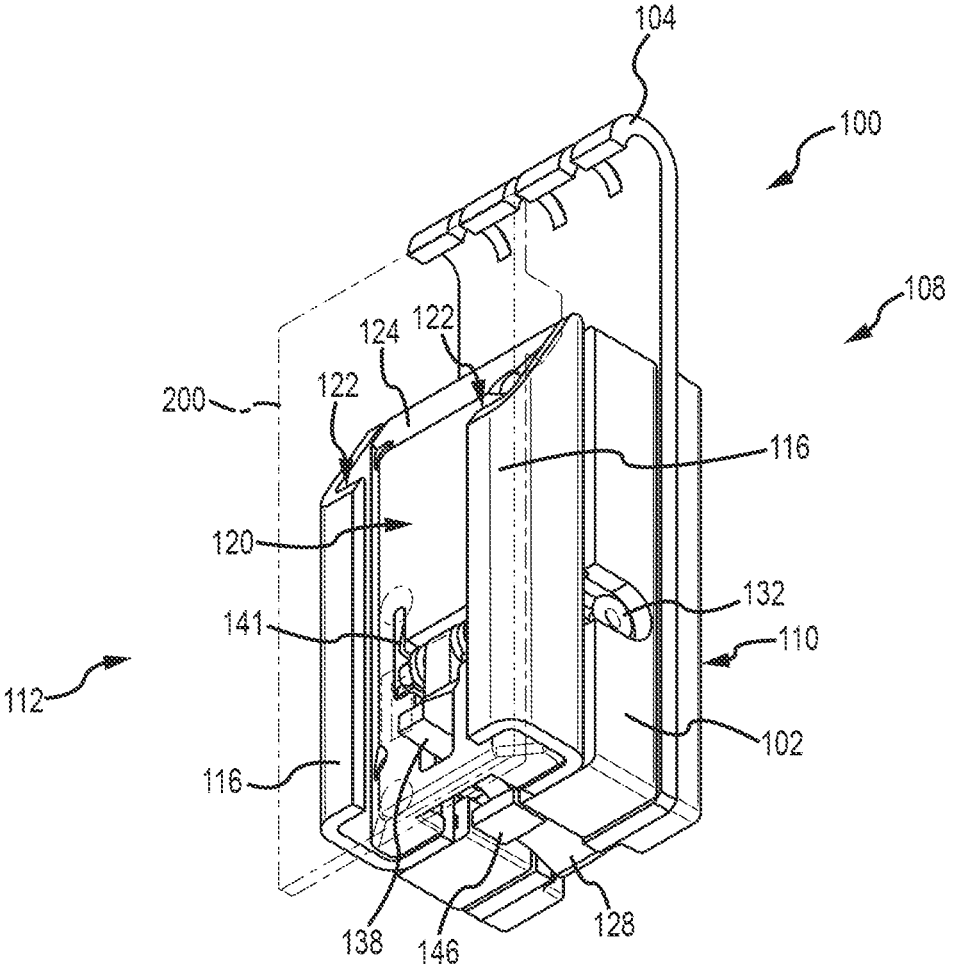
FIGS. 3A-3C depicts lower perspective views of a carrier for a window balance system having a brake in a stored, extended, and deployed position, respectively.
Figure 3B:
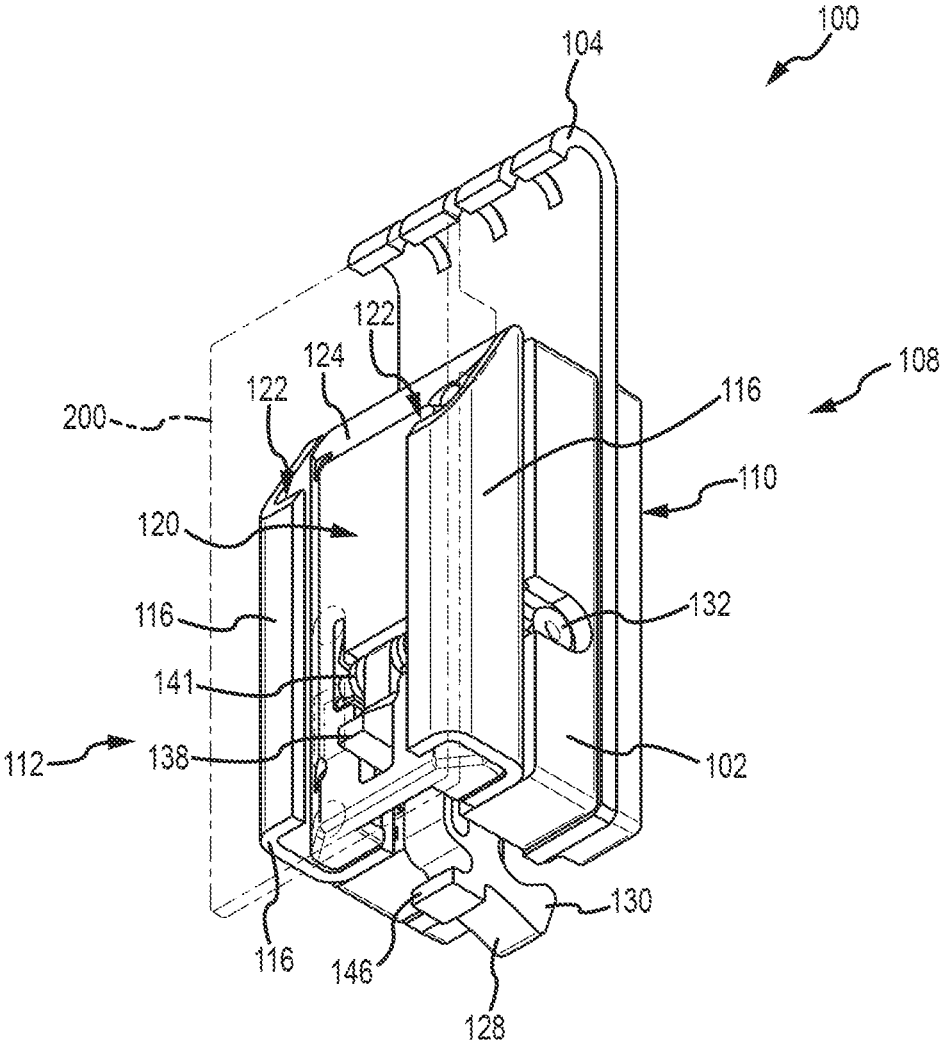
Figure 3C:
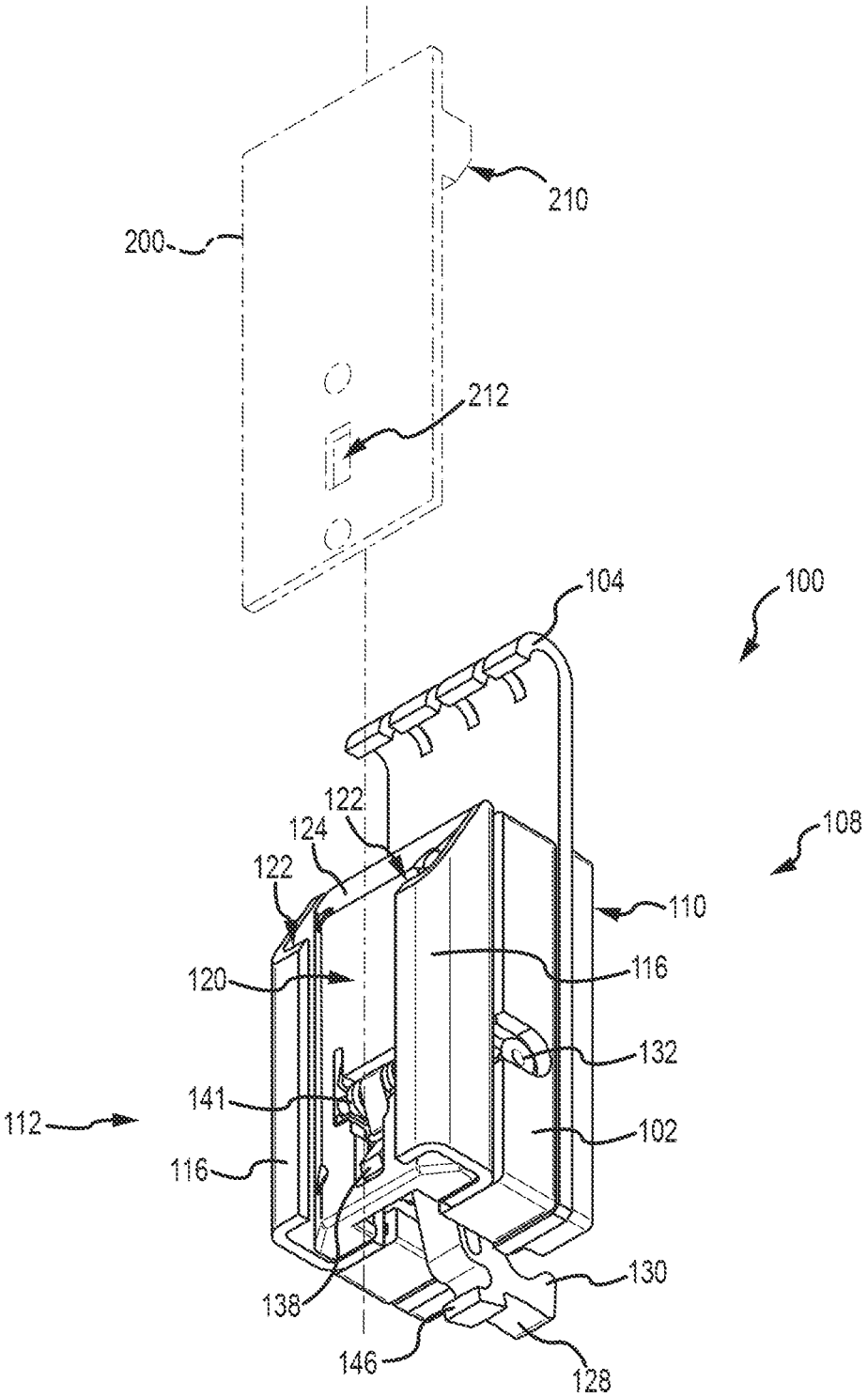

FIGS. 3A-3C depict lower perspective views of a carrier 100 for a window balance system having a brake 128 in a stored, extended, and deployed position, respectively. Certain components of the carrier 100 are depicted and described further with regard to FIGS. 1A and 1B and are thus not necessarily described further. In FIG. 3A, the brake 128 is in a stored position, such that the brake 128 is substantially contained within the body 102 of the carrier 100. With the brake 128 in the stored position, because of the relationship between the brake 128 and the lock 138, the lock 138 extends from the guide 124 into the bracket receptor 120. This extended or locked portion prevents disengagement of the bracket 200 from the carrier 100. The projection 146 of the brake 128 can be accessed and pulled by a tool or finger. Once pulled, the brake 128 is in an extended position, as depicted in FIG. 3B. In the extended position, the brake 128 extends below a lower surface of the body 102 of the carrier 100. Due to the relationship between the brake 128 and the lock 138, the lock 138 still projects from the guide 124. The spring 141 exerts a biasing force against the pivotable lock 128. This biasing force pushes the lock 138 into the body 102 and out of the bracket receptor 120. Due to the relationship between the brake 128 and the lock 138, the brake 128 forces the lock 138 to pivot towards the rear side 108 of the carrier 100. This places the brake 138 in the deployed position depicted in FIG. 3C, where the hook 130 is positioned so as to be able to engage an opening in a window jamb, as described below. Once the lock 138 is out of the bracket receptor 120 (and recess 212 of the bracket 200), the bracket 200, and therefore the window sash, can be lifted off of the carrier 100.

Figure 4A:
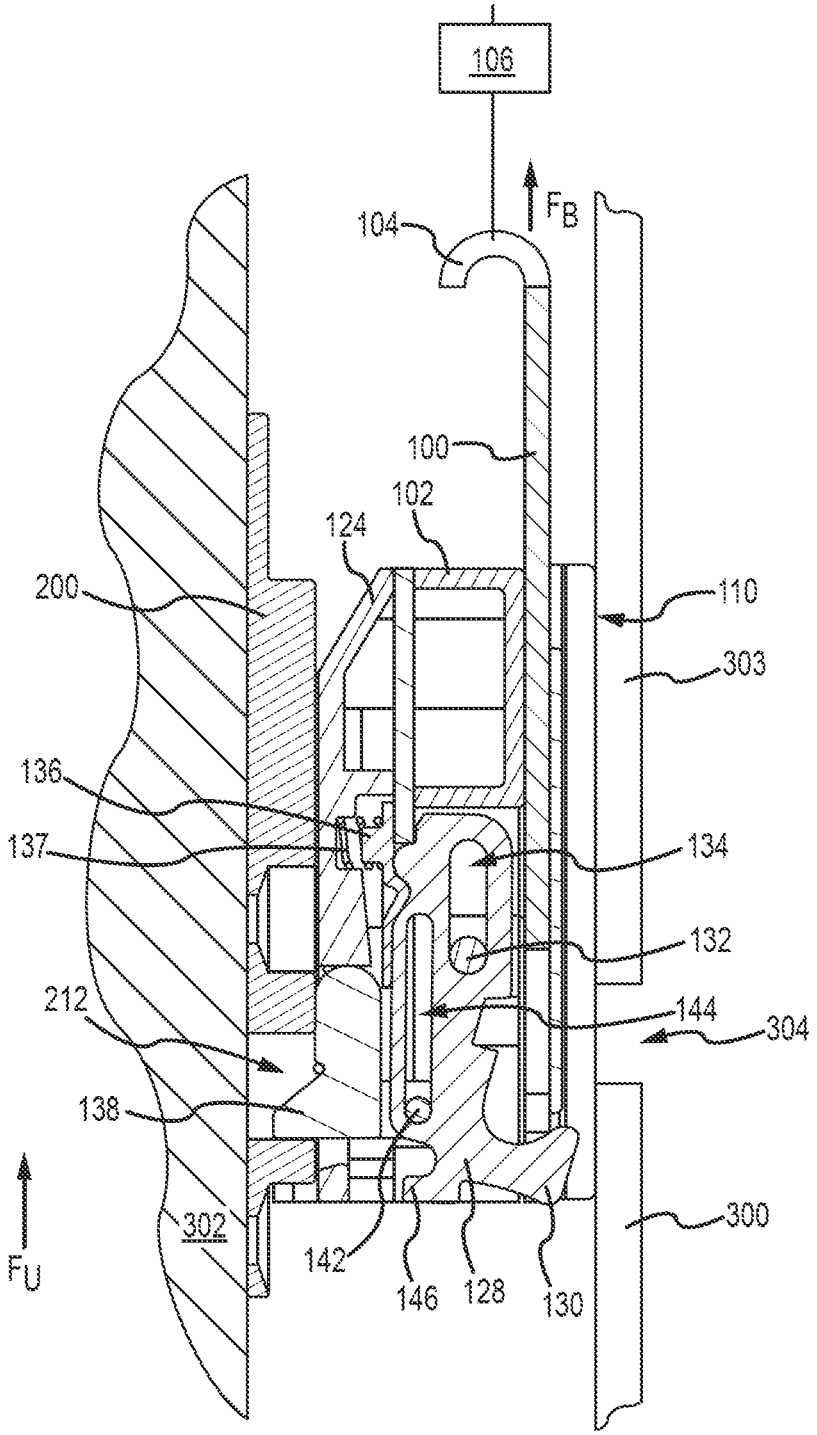
FIGS. 4A-4C depict side sectional views of a carrier and bracket assembly for a window balance system.
Figure 4B:
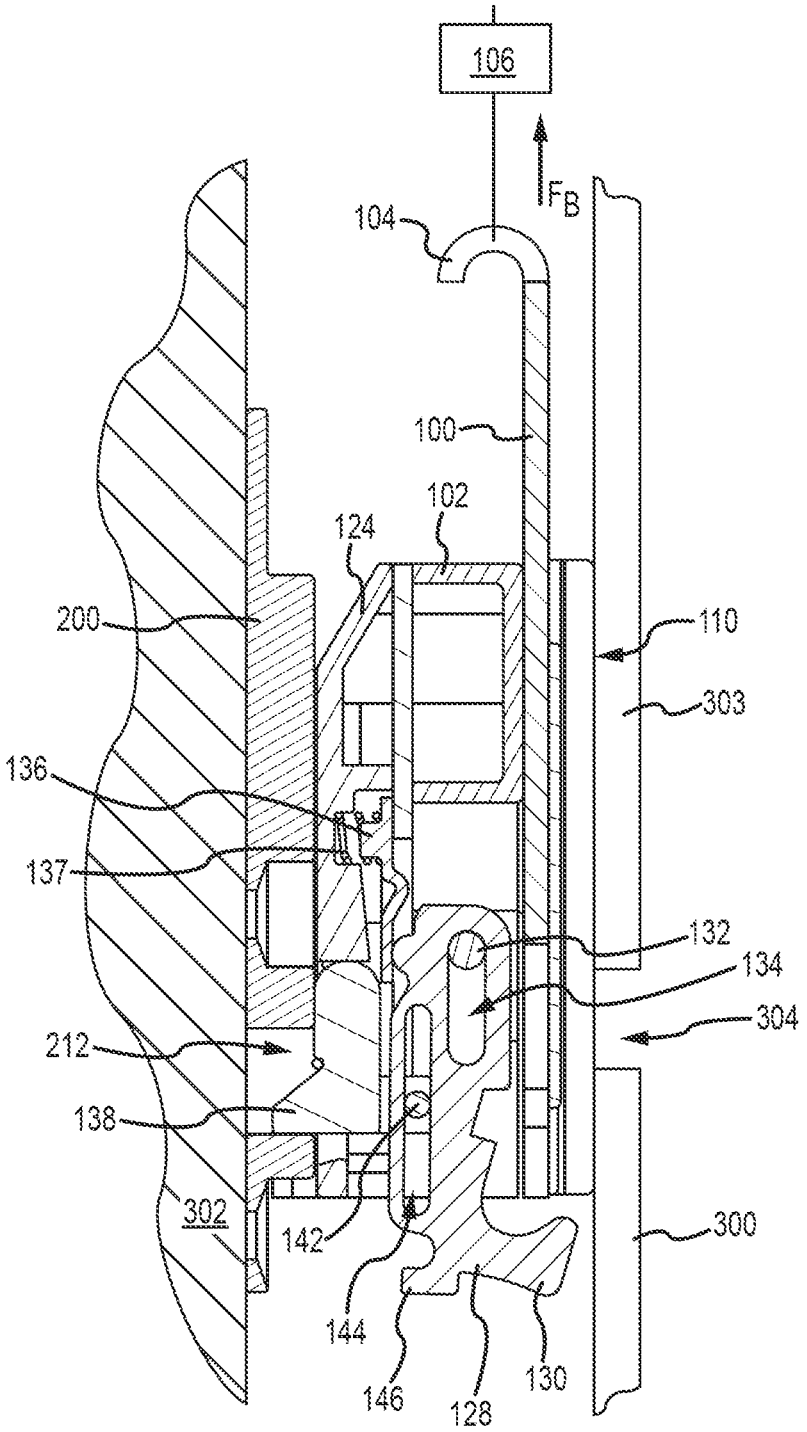
Figure 4C:
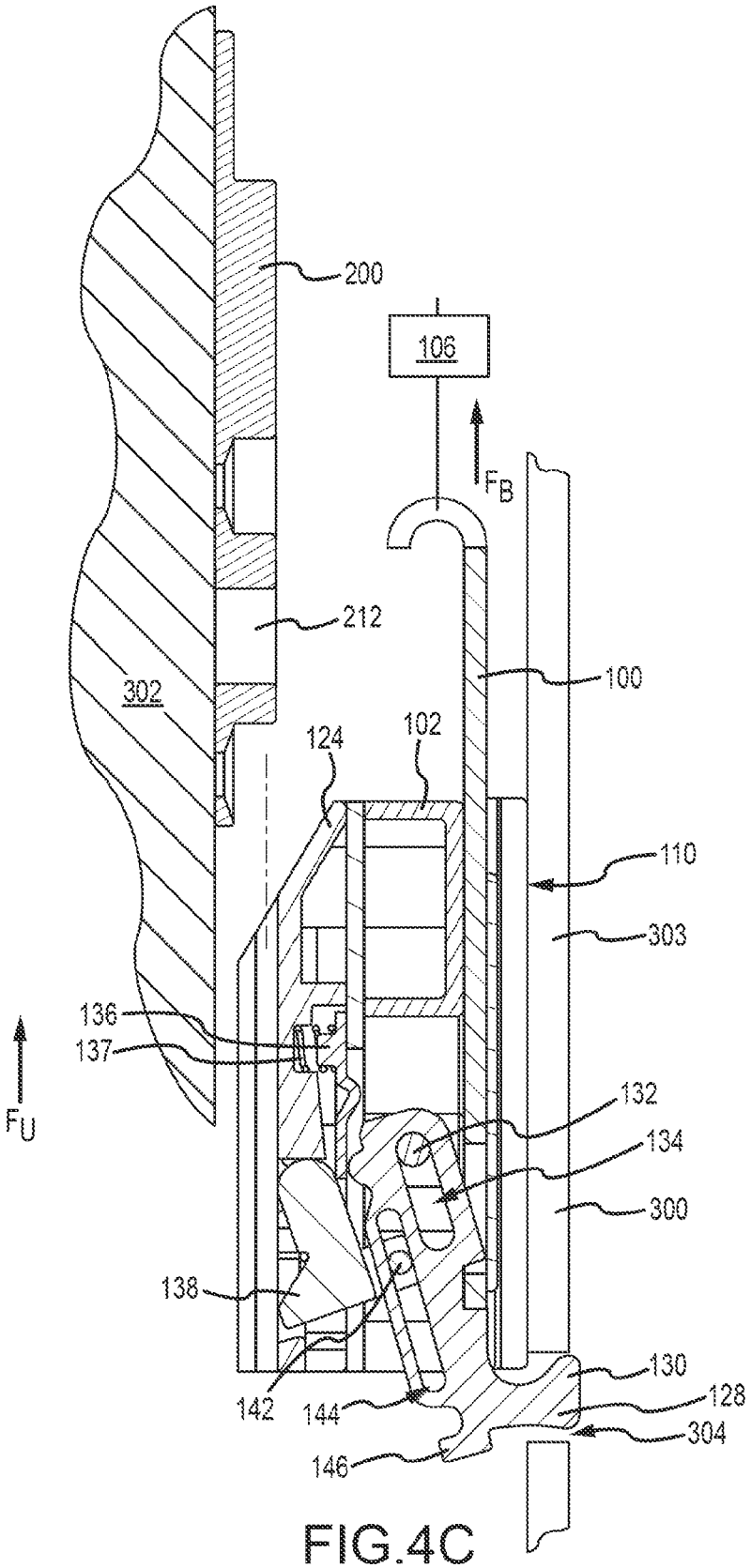

FIGS. 4A-4C depict side sectional views of the carrier 100 and the bracket 200. In FIGS. 4A-4C, a window jamb 300 (against which the carrier 100 slides at sliding surfaces 110) and a window sash 302 (to which the bracket 200 is secured) are also depicted. FIG. 4A depicts the condition when the carrier 100 and the bracket 200 are fully engaged. Here, also, the bracket 200 is secured to the window sash 302 and the carrier 100 is connected to a spring 106 at a balance hook portion 104. The spring 106 provides a balance force $F_B$ on the sash 302. The weight of the window sash 302 is transferred to the carrier 100 via the bracket 200. More specifically, the shoulders 210 (not depicted in FIGS. 4A-4C) of the bracket 200 are engaged with the angled engagement faces 122 (not depicted), such that the weight of the window sash 302 is borne by the carrier 100. Here, notably, the brake 128 is in the stored position and the pivotable lock 138 extends into the recess 212 of the bracket 200. With the brake 128 in the stored position, the window sash 302 can be raised and lowered in the window jamb 300. The sliding surfaces 110 slide along a rear wall 304 of the window jamb 300. With the pivotable lock 138 extends into the recess 212 of the bracket 200, an upward force $F_U$ applied to the window sash (e.g., during lifting) does not disengage the bracket 200 from the carrier 100. Utilization of the pivotable lock 138 also prevents the sash 302 from being inadvertently disengaged from the carrier 100. For example, should the carrier 100 become unexpectedly jambed in the window jamb 300, further upward force $F_U$ on the sash 302 will not disengage the sash 302 from the carrier 100, due to the presence of the lock 138 in the recess 212.

FIG. 4B depicts the condition when the brake 128 has been extended from the carrier 100 in preparation to secure the carrier 100 to the window jamb 300 (to allow removal of the sash 302 from the carrier 100). Here, a tool or finger is engaged with the brake projection 146 so as to slide the brake 128 down and out of the body 102 of the carrier 100. The spring 137 allows for disengagement between the retention clip 136 and brake 125 and returns the retention clip 136 to the positions depicted in FIGS. 4A-4C, after disengagement. At this instant, the lock 138 is still engaged with the recess 212. As the brake 128 is lowered, however, the spring 141 (not depicted) exerts a biasing force against the pivotable lock 138. This causes a pivoting movement of both the pivotable lock 138 and the brake 128, such that both components are disposed in the positions depicted in FIG. 4C. The pivotable lock 138 is retracted into an unlocked position by the force of the biasing spring 141 and, as such, is disengaged from the recess 212 of the bracket 200. The brake 128 is pivoted toward the window jamb 300, such that the anchor hook 130 is in a deployed position such that it contacts the rear surface 303 of the window jamb 300 as the sash 302 is lifted. As the sash 302 is raised, the anchor hook 130 engages an opening or slot 304 in the rear wall 303 of the window jamb 300. Further upward force $F_U$ exerted against the window sash 302 lifts the sash 302 off of the carrier 100, by slidably disengaging the vertical rail system (e.g., channels 116) from the bracket 200 (e.g., projections 204). The sash 302 can now be replaced.

Figure 5A:
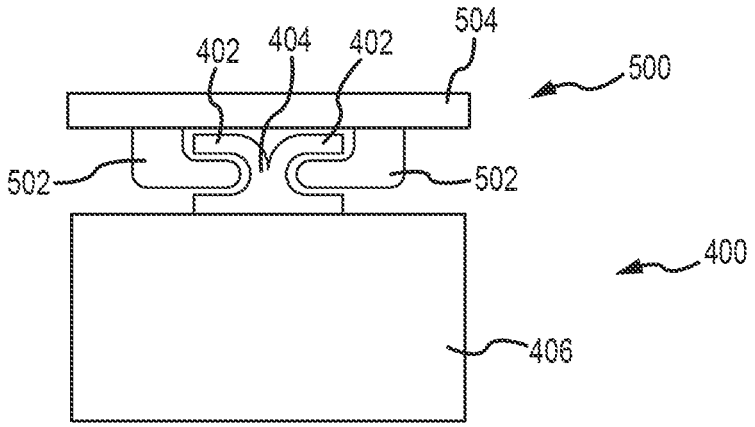
FIGS. 5A-5E depict top sectional views of alternative embodiments of carrier and bracket assemblies.
Figure 5B:
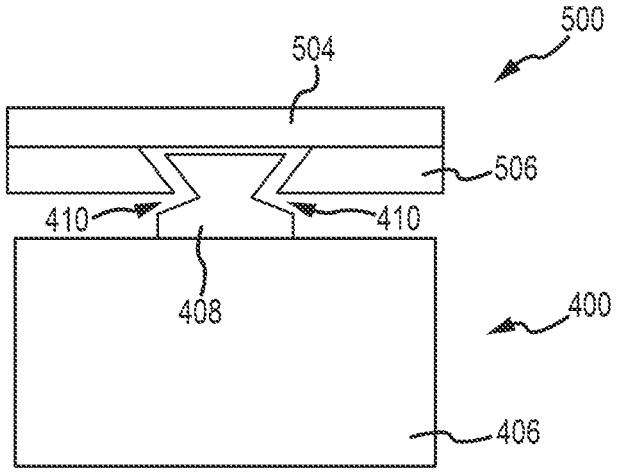
Figure 5C:
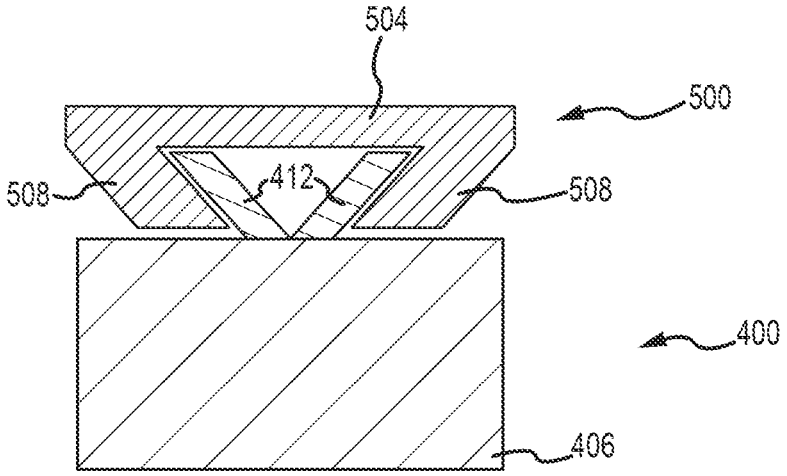

FIGS. 5A-5E depict top sectional views of alternative embodiments of carrier 400 and bracket 500 assemblies. Specifically, these figures depict different embodiments of the mating elements of carriers 400 and brackets 500. In FIG. 5A, for example, the carrier 400 includes a vertical rail system in the shape of a pair of joined U-shaped channels 402 extending therefrom. Here, the open portions of the U-shaped channels 402 face away from each other. The U-shaped channels 402 are joined at their respective bases so as to form a single rail 404 that is attached to or integral with a body 406 of the carrier 400. Armatures 502 extend from a plate 504 of the bracket and engage with the U-shaped channels 402. FIG. 5B depicts another embodiment of carrier 400 and bracket 500 assemblies. Here, a body 406 of the carrier includes a vertical rail system in the shape of a block 408 secured thereto or integral therewith. The block 408 defines a plurality of V-shaped channels 410 configured to receive teeth 506 that extend from the plate 504 of the bracket 500. FIG. 5C depicts another embodiment where the body 406 includes a vertical rail system in the shape of a pair of angled projections 412 that extend therefrom. Mating angled projections 508 extend from the plate 504 of the bracket 500 and are configured to mate with the pair of angled projections 412.

Figure 5D:
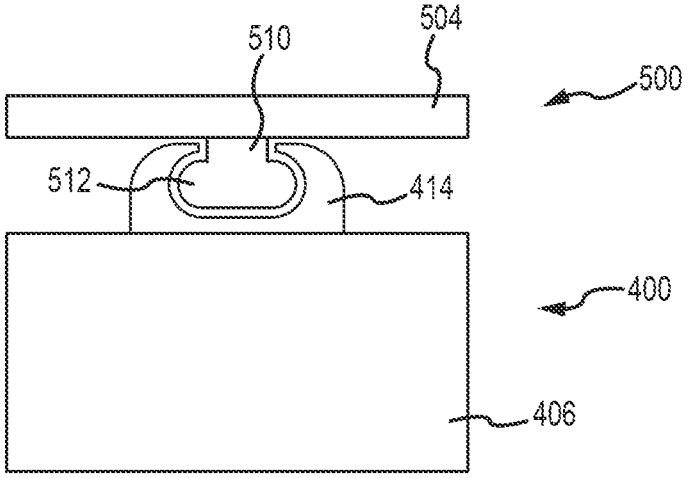
Figure 5E:
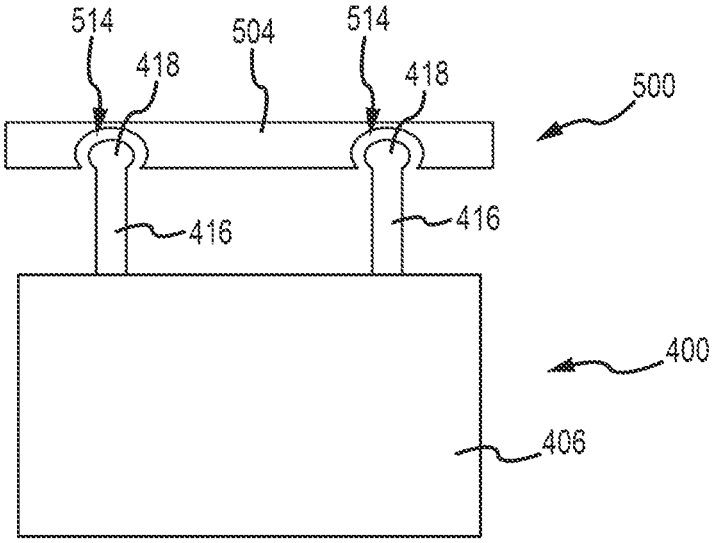

FIG. 5D depicts another embodiment of a vertical rail system for a carrier 400 and bracket 500, in the shape of a C-shaped bracket 414. The C-shaped bracket 414 slidably mates with an elongate pin projection 510 having an enlarged head 512. The enlarged head 512 prevents the pin 510 from being pulled from the C-shaped bracket 414. In FIG. 5E, a plurality of pins 416 extend from the body 406. Each pin 416 includes an enlarged head 518. Each head 518 is sized to as to fit within a channel or opening 514 defined by the plate 504 of the bracket 500. Other vertical rail systems utilized in conjunction with the carrier and brackets described herein are contemplated. In general, however, vertical rail systems (and their mating counterparts on a bracket) share certain attributes, regardless of configuration. For example, the vertical rails are generally elongate or are comprised of discrete components that are substantially aligned so as to operate similar to a single rail. The vertical rail systems and mating counterparts are configured with tolerances to prevent or limit play between the carrier and the bracket. Additionally, the vertical rail systems are configured so as to prevent the bracket from pulling away from the carrier.

Figure 6A:
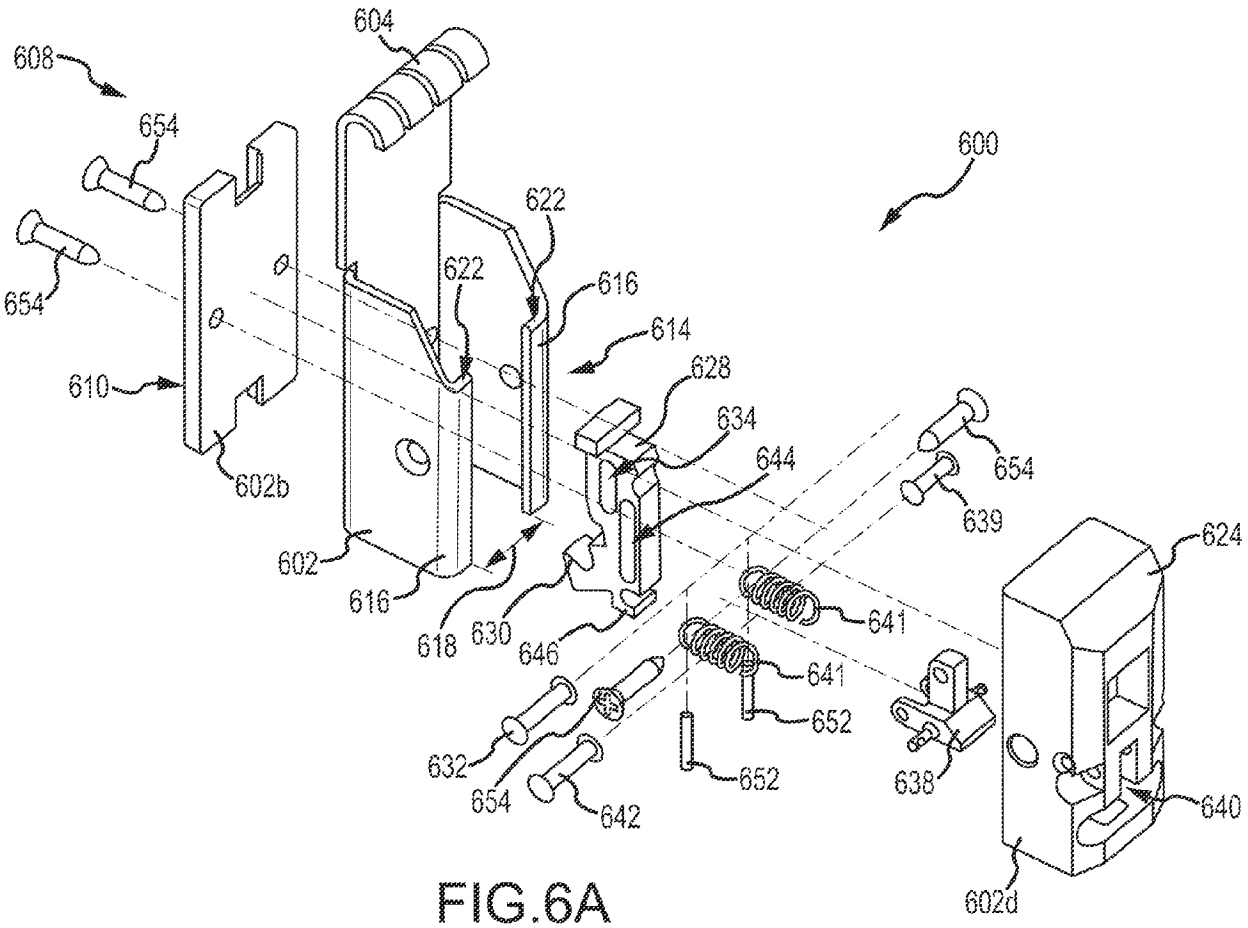
FIGS. 6A-6D depict various views of a carrier for a window balance system, in accordance with another embodiment.
Figure 6B:
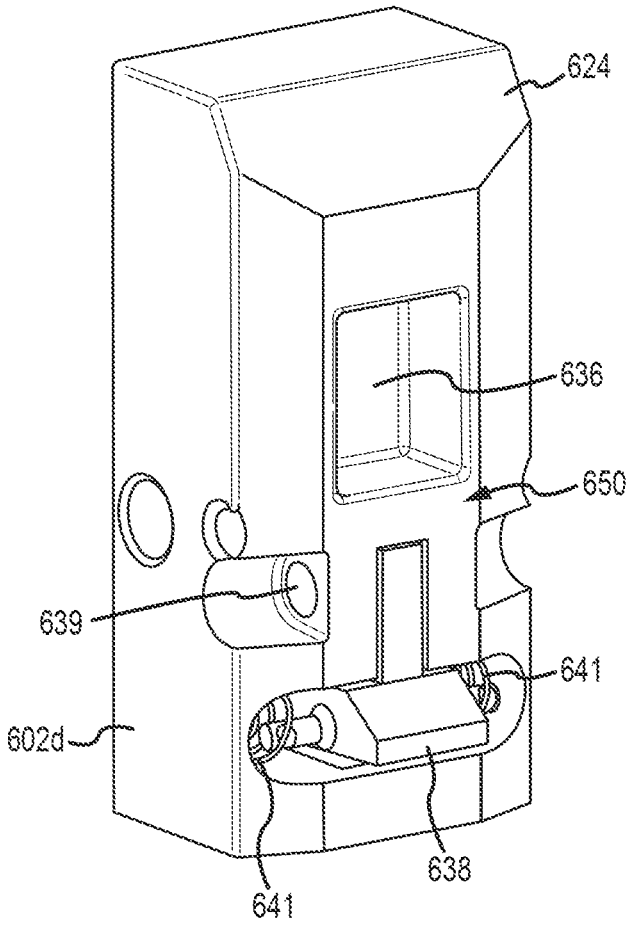
Figure 6C:
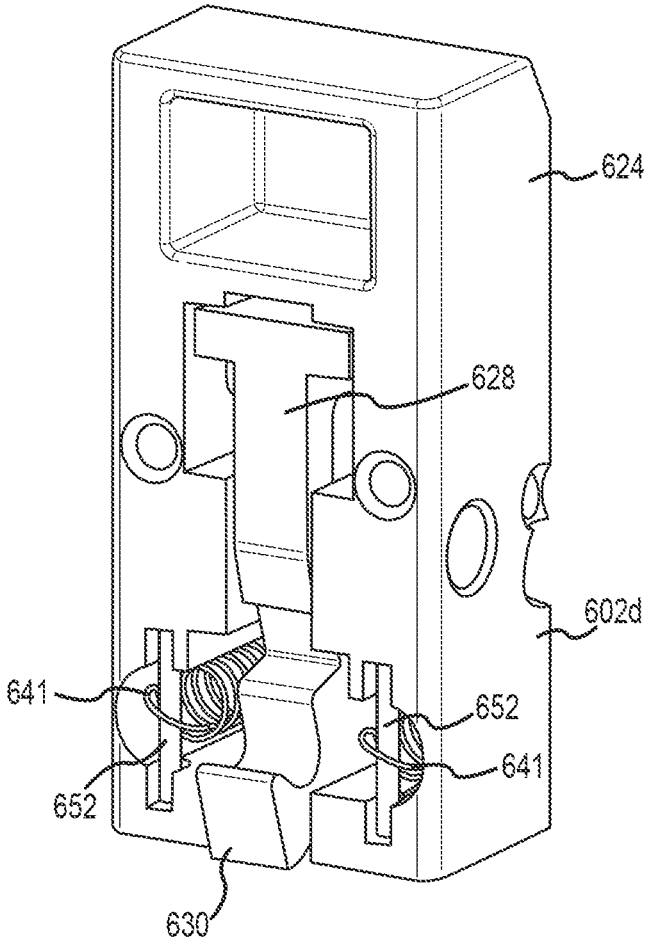
Figure 6D:
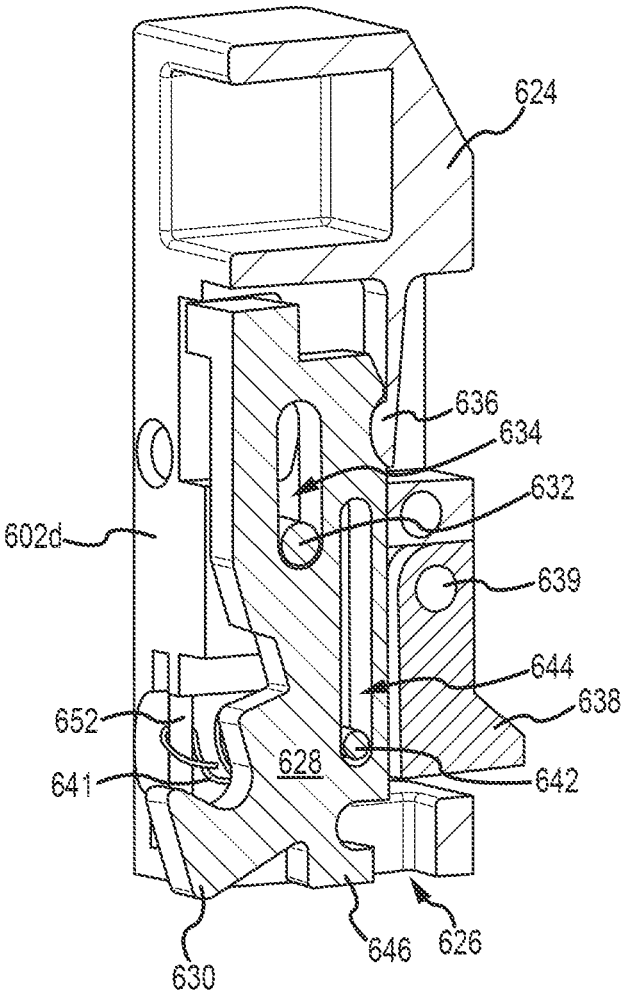

FIGS. 6A-6D depict various views of a carrier 600 for a window balance system, in accordance with another embodiment. More specifically, FIG. 6A depicts an upper perspective exploded view of a carrier 600. FIGS. 6B and 6C depict front and rear perspective views, respectively, of a body portion 602*d* of the carrier 600. FIG. 6D depicts a side perspective sectional view of the body portion 602*d*. FIGS. 6A-6D are described simultaneously.

The carrier 600 includes a body 602 that can be formed from one or more discrete molded components. In this embodiment, body 602 integrates a balance hook portion 604 and a vertical rail system 614. Components 602*b* and 602*d* can be discrete from or integral with body 602 and can perform other functions, as described below. The balance hook portion 604 is configured to be connected to a spring (not depicted), as described generally above. A rear side 608 of the body 602*b* can include one or more vertical sliding surfaces 610 secured thereto or formed thereon. The sliding surfaces 610 are configured to slide along a rear wall of a window jamb, when the carrier 600 moves in a window jamb. The vertical rail system 114 or bracket mating element is integral with the body 602 in this embodiment. The vertical rail system 614 is configured to mate with a bracket, such as that described herein.

The vertical rail system 614 includes, in the depicted embodiment, two substantially L-shaped rail members 616 that extend from the balance hook portion. The rail members 616 are disposed so as to face towards each other. The members 616 are spaced apart from each other by a gap 618. When the body component 602*d* is inserted between the two L-shaped rail members 616, a front face 650 of the body component 602*d* and the L-shaped rail members 616 at least partially define a bracket receptor as described elsewhere herein. A top portion of each L-shaped rail member 616 defines an angled engagement face 622 that acts as a bearing surface configured to engage the bracket, as described herein. The body portion 602*d* of the carrier 600 also includes a guide 624 that aids in installing the bracket in the bracket receptor. Portions of the carrier body portion 602*d* define several openings that receive a number of components that improve performance of the carrier 600. For example, the body 602*d* at least partially defines a brake opening 626 that receives a brake 628 that includes an anchor hook 630. The brake 628 is slidably and pivotably received within the body 602*d* via a brake pin 632 and elongate brake pin slot 634 that receives the brake pin 632.

A retention clip 636 is integrated into the body 602*d* and is configured to retain the brake 628 when the brake 628 is in a stored position substantially received in the body 602*d* of the carrier 600. An interlocking pawl or lock 638 is pivotably engaged about an axle 639 and is disposed substantially within a lock opening 640. Two springs 641 are configured to bias the lock 638 towards the brake 628. Each spring 641 is connected at a first end to the lock 638 and at a second end to a pin 652 that is received in the body 602*d*. The lock 638 and brake 628 are engaged via an engagement pin 642 and an elongate engagement pin slot 644. Thus, certain movements of the brake 628 are dependent on certain movements of the lock 638. For example, the brake 628 can slide up and down within the body 602*d*. However, the spring 641 biases the lock 638 towards the brake 628; thus, a pivoting movement of the lock 638 causes a corresponding pivoting movement of the brake 628. The brake 628 also defines a projection 646 that can be accessed by a tool or finger as described in further detail below. A number of screws 654 are utilized to secure the various components of the body 602 to each other.

Figure 7:
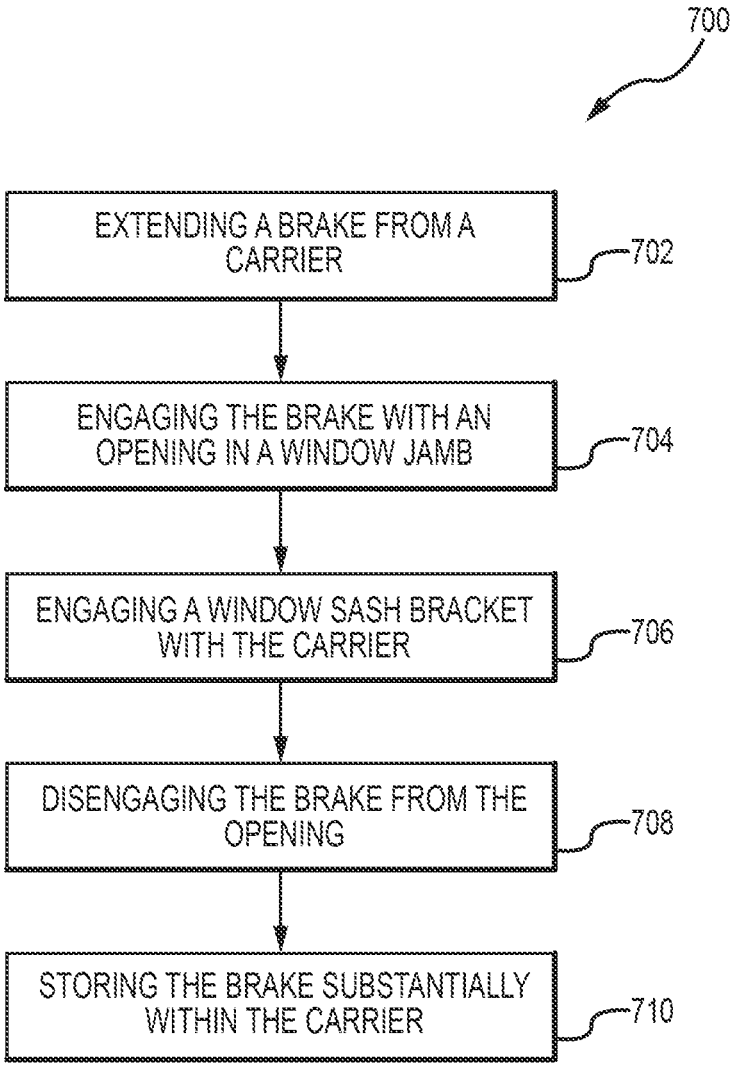
FIG. 7 depicts a method of installing a window sash on a carrier of a window balance.

FIG. 7 depicts a method 700 of installing a window sash on a carrier of a window balance. The carrier is disposed in a window jamb to support the window sash. The method 700 begins by extending a brake from the carrier of the window balance, operation 702. Thereafter, the method 700 includes engaging the brake with an opening in the window jamb, operation 704. A window sash bracket is next engaged with the carrier, operation 706. This engagement may be a sliding mating engagement between the carrier channels and sash bracket projections, as described herein. The brake may then be disengaged from the opening, operation 708. During window fabrication and manufacture, this may include sliding the window sash down in the window jamb so as to disengage the brake from the opening. Thereafter, the brake is stored substantially within the carrier, operation 710. As the brake as stored, due to the relationship between the brake and a lock on the carrier, the brake substantially simultaneously extends a lock into a recess in the window sash bracket. This locks the window sash to the carrier, thus preventing inadvertent disengagement thereof. To remove the window, these operations are generally reversed. Extending the brake may be performed with a tool or fingers.

The materials utilized in the manufacture of the window balance system may be those typically utilized for balance manufacture, e.g., molded or stamped plastic or metal. Material selection for most of the components may be based on the proposed use of the balance, robustness desired, weight of the window sash, etc. Rigid molded plastic, such as PVC, ABS, HDPE, polyethylene, etc., may be utilized for the various components, as well as metals such as zinc, steel, brass, and stainless steel. Nylon, acetal, Teflon®, or combinations thereof may be utilized for to reduce friction between components that slidably engage, e.g., the vertical rail system and bracket projections, as well as the rear sliding surfaces and brake. Other low-friction materials and/or component coatings are contemplated.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A carrier for a window sash comprising:

a balance connecting portion configured to be connected to a window balance;

a body, wherein the balance connecting portion is connected to the body;

a brake pivotally and slidably connected to the body; and a vertical rail system connected to the body, wherein the vertical rail system is configured to slidingly engage a bracket of the window sash.

2. The carrier of claim 1, further comprising a sliding surface disposed opposite the vertical rail system, wherein the sliding surface is adapted to slide in a jamb channel of a window jamb.

3. The carrier of claim 1, wherein the vertical rail system is integral with the body.

4. The carrier of claim 3, wherein the vertical rail system comprises a first rail member and a second rail member disposed in opposition to the first rail member.

5. The carrier of claim 4, wherein the first rail member and the second rail member each comprise a channel.

6. The carrier of claim 4, wherein each of the first rail member and the second rail member each comprise a substantially U-shaped channel.

7. The carrier of claim 6, wherein an open portion of the first rail member faces toward an open portion of the second rail member.

8. The carrier of claim 4, further comprising a lock pivotably connected to the body.

9. The carrier of claim 8, wherein the first rail member and the second rail member at least partially define a bracket receptor, and wherein the lock is configured to pivotally extend into the bracket receptor and pivotally retract from the bracket receptor.

10. The carrier of claim 8, wherein a position of the lock is dependent on a position of the brake.

* * * * *